US005598383A

United States Patent [19]

Li

[11] Patent Number: 5,598,383

[45] Date of Patent: Jan. 28, 1997

[54] WATCH WITH DOUBLE THREAD COUPLING DEVICE

[76] Inventor: Tai H. Li, No. 1, Alley 5, Lane 23, Shiaw 1 Rd., Keelung, Taiwan

[21] Appl. No.: 342,454

[22] Filed: Nov. 17, 1994

[51] Int. Cl.[6] ..... G04B 37/00

[52] U.S. Cl. ..... 368/291; 368/308; 368/309; 368/306

[58] Field of Search ..... 368/281, 282, 368/307, 291, 306, 276

[56] References Cited

U.S. PATENT DOCUMENTS

| | | | |
|---|---|---|---|
| 666,569 | 1/1901 | Sporleder | 368/306 |
| 691,412 | 1/1902 | Sporleder | 368/307 |
| 1,853,388 | 4/1932 | Wadsworth | 368/291 |
| 2,327,112 | 8/1943 | Kramer et al. | 368/291 |
| 2,617,249 | 11/1952 | Devay | 368/276 |

FOREIGN PATENT DOCUMENTS

| | | | |
|---|---|---|---|
| 241961 | 4/1946 | Switzerland | 368/291 |
| 340786 | 10/1959 | Switzerland | 368/310 |

*Primary Examiner*—Bernard Roskoski
*Attorney, Agent, or Firm*—W. Wayne Liauh

[57] ABSTRACT

A watch with improved water-proof and pressure-resistance characteristics is disclosed. It comprises: (a) a casing, a bottom cover affixed to the casing, a screw winding crown, and a receiving port on the casing for receiving the screw winding crown; (b) a first double-thread coupling arrangement provided between the screw winding crown and the receiving port; and (c) a second double-thread coupling arrangement provided between the casing and the bottom cover. The first double-thread coupling arrangement comprises an externally and internally threaded annular section provided on the screw winding crown, a matching externally and internally threaded annular recess provided in the receiving port, and a first packing ring provided between the receiving port and the screw winding crown. The second double-thread coupling arrangement comprises an externally and internally threaded annular protrusion provided on the casing, a matching externally and internally threaded annular groove provided in the bottom cover, and a second packing ring provided between the casing and the bottom cover.

1 Claim, 2 Drawing Sheets

WATCH WITH DOUBLE THREAD COUPLING DEVICE

DESCRIPTION

Figure 1:
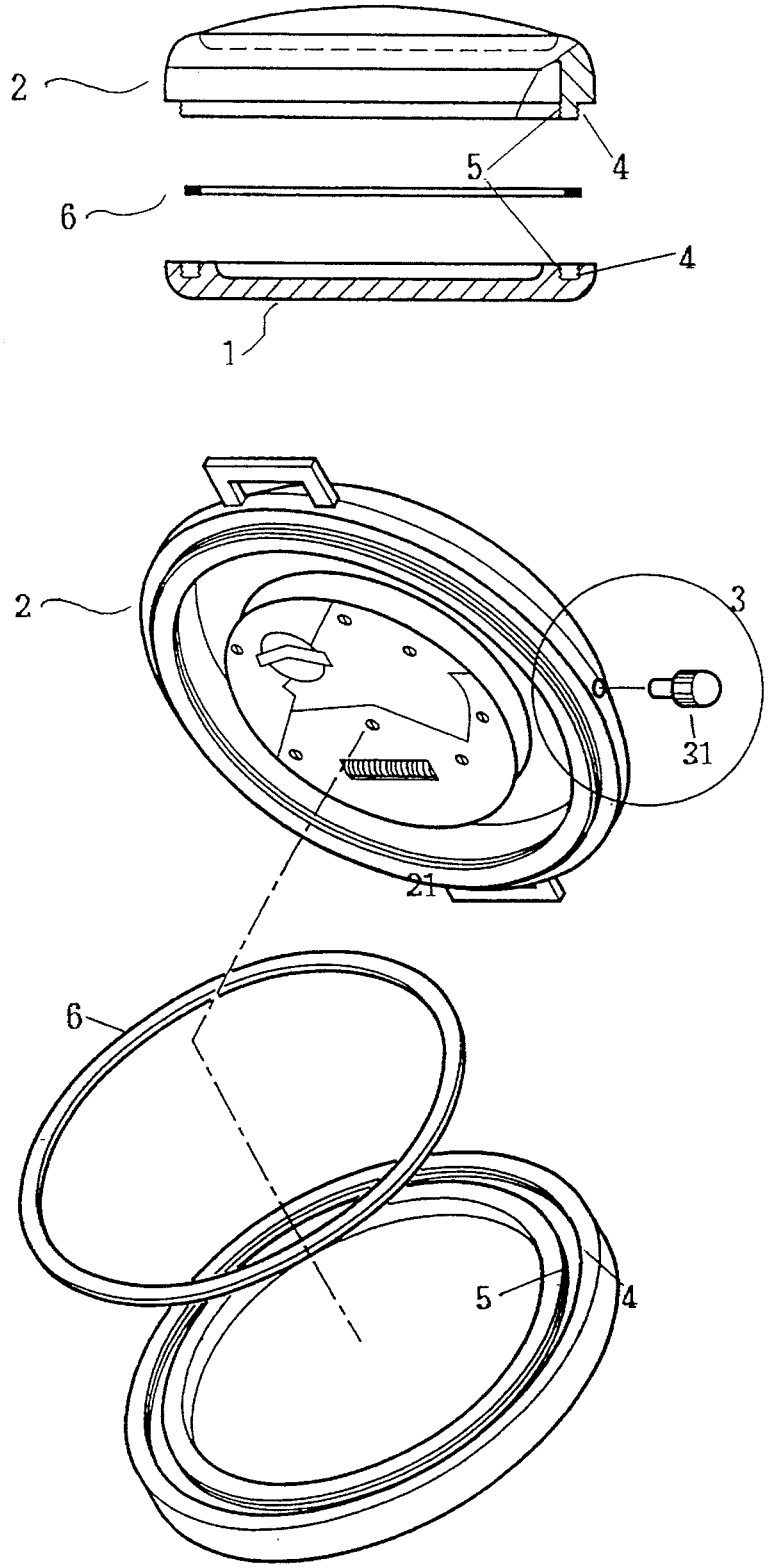

Now-a-day, watch becames an indispensable article in humen life and almost every one carry/wear it for 24 hours full time, particularly for the wrist-watch wearer who customarily not to take their watch off from their wrist even during the bed-time, swimming and bath since most of the wrist watches has additional function of being water-proof and anti-pressure.

On the part of water-proof and anti-pressure for the construction of a watch, the conventional manner is such, that the threads of bottom flange and casing is directly engaged with each other with a washer made from some kind of soft material placed in between and to be squeezed when former two is tightly engaged so as to make the casing as a whole is water-tight and anti-pressure. Same manner is also applied to the portion of screw winding button.

The so-called water proof and anti-pressure arrangement made by the conventional manner is not positively effective for the following reasons:

1. In the case of conventional mechanical watch, the screw winding button and winding shaft are subjected to rotating for winding-up and time calibration, this will cause the so-called water/air-tight sealing arrangement stated above start to shake and gradually lose its tightness. Also, the casing and cover may have to be disconnected for repair & maintenance, once this is happened, its function on waterproof and anti-pressure shall to lose gradually due to the deformation and degradation of soft washer.

2. In the case of electronic and digital watch, although they do not have screw winding button and shaft, but instead they have time-setting screw to be thread through the casing which also need to have water-proof arrangement. Also, the casing and cover for this type of watch has to be disengaged more often for the purpose of battery replacement.

In the last two decades, watch design had made a revolutional advancement as the electronic/digital watch almost has taken the whole watch market from conventional mechanical watches. Improvement has also been made continuesly on its configuration weight and multiple characters/functions, but its design on the part of water-proof and anti-pressure remains the same as before.

In view of the above, the inventor, through his many years research and experiment, has found this double-thread arrangement is well adoptable in the construction of a watch for improving its effectiveness on water-proof and anti-pressure.

The structure of this arrangement is to provide an external thread portion and an internal thread portion in the bottom cover with a packing ring placed in between, and also an external thread portion and an internal thread portionin the watch casing with a contact surface in between. When these two members coupled together through this double thread, which urge the contact surface to press against the packing in order to make an air-tight seal for the watch. Same manner is also applied to the portion of winding button or time setting screw.

With this kind of sealing arrangement, the cover and casing is much more tightly and strongely in mesh with each other, and the packing ring, also made from the metal, shall not to be deformed and degraded so easily as the soft washer of the conventional watch. Therefore, when this double-thread arrangement according to the invention is used in the construction of a watch, its effectiveness on the water-proof and anti-pressure shall be greatly improved and so as its lifetime is undoubtable extended. Of course, same reason shall also appliable to the portion of screw winding button or time setting screw.

Figure 2:
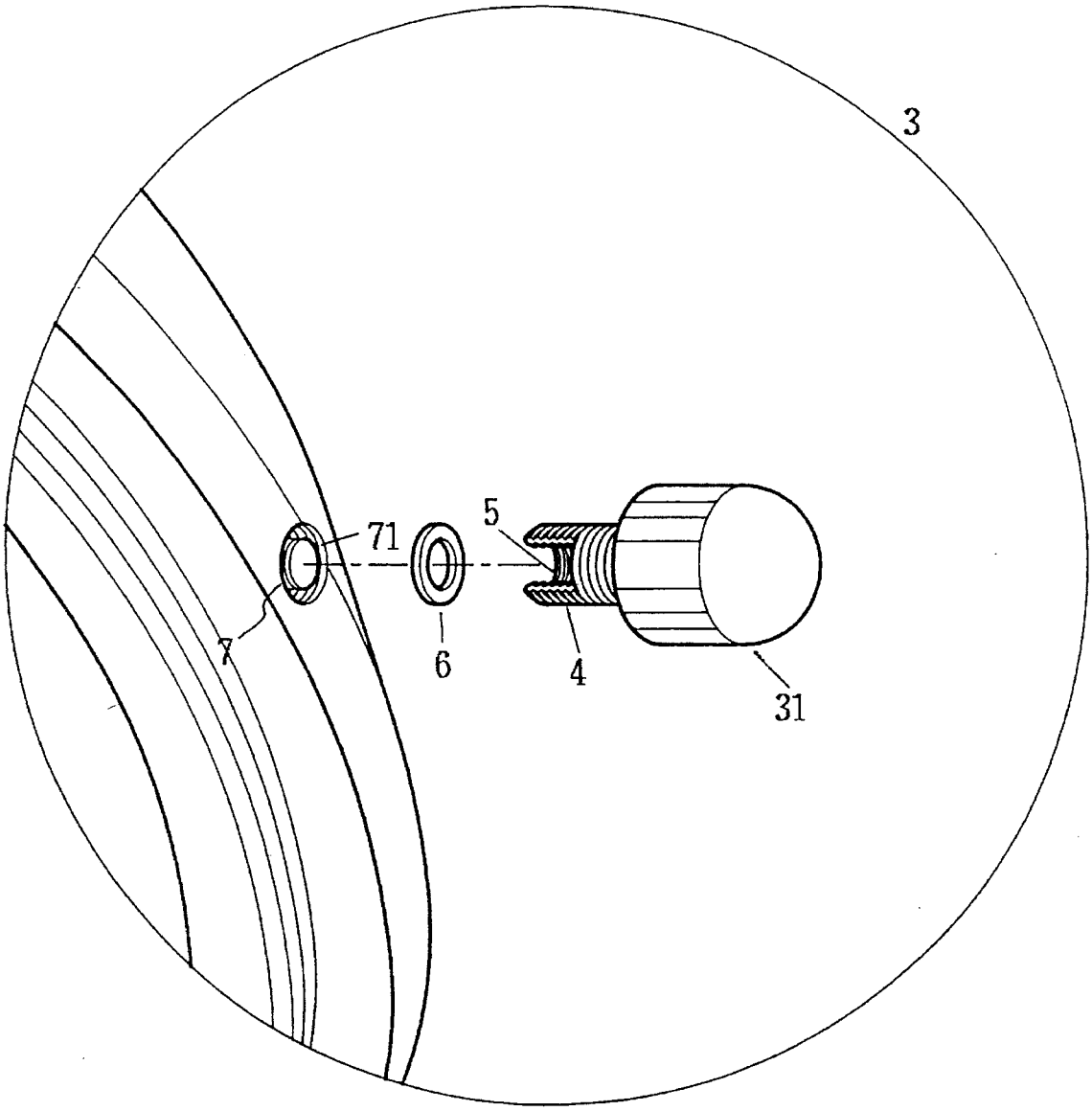

Now, the invention will be further explained hereinafter by reference to the drawings, in which;

FIG. 1 is an exploded view showing different parts of an ordinary watch with mechanical or electronic structure omitted, and FIG. 2 is a schematic diagram showing te embodiment of the invention:

The parts illustrated in the FIG. 1 are denoted by the following reference number:

(1) Bottom Cover.

(2) Casing.

(3) Screw Winding button.

(4) External Thread portion.

(5) Internal Thread portion.

(6) Packing Ring.

(7) Receiving port.

(21) Contact Surface.

(31) Winding Crown.

(71) Top surface of port.

Refer to FIG. 2, a schematic diagram showing the embodiment of the invention, in which, this double thread arrangement is provided in both bottom cover and casing in such an order. That is EXTERNAL THREAD PORTION-PACKING RING-INTERNAL THREAD PORTION in the direction from outside to inside for the bottom cover and EXTERNAL THREAD PORTION-CONTACT SURFACE-INTERNAL THREAD PORTION in the direction from outside to inside for the casing. When these two members coupled together through this double thread, the external thread portion of bottom cover is to be in mesh with the external thread portion of the casing and in the same time the internal thread portion of bottom cover is to be in mesh with the internal thread portion of the casing.

In the process of this engagement, when these two members gradually moved towards each other through this thread arrangement, the contact surface of the casing is also moved towards the packing and tightly press against it at the end of this thread engagement, and a water-proof seal is thus accomplished. Also, the double thread arrangement for the part of winding button (3) is similar to that of the casing and bottom cover. The order of arrangement is such, that is EXTERNAL THREAD PORTION-PACKING-INTERNAL THREAD PORTION in the direction from outside to inside for the part of winding crown (31), and EXTERNAL THREAD PORTION-RECEIVING PORT TOP SURFACE-INTERNAL THREAD PORTION the direction from outside to inside for the part of receiving port (7).

When these two parts coupled together through the double thread, the external thread portion of the winding crown is to be in mesh with the external thread portion of receiving port (7) and in the same time the internal thread portion of winding crown (31) is to be in mesh with internal thread portion of the receiving port (7). In the process of this engagement, when these two parts gradually moved towards each other through this thread arrangement, the packing ring is also moved towards the top surface (71) of the receiving port (7) and tightly press against it at the end of this engagement so as to make this part to be air-tightly sealed.

The thread on any of the above mentioned part can be male female as long as it is different to its relative part to the engaged to. That is to say if the external thread portion of bottom cover is male thread, then, the external thread portion of the casing should be female thread. Same situation should be applied to the other parts.

From the foregoing it will be clear that in comparasion with the sealing arrangement made by the conventional watches, this double thread arrangement of the invention apparently has much better effect on water-tight function as well as anti-pressure, and the lifetime of a watch will be great extended when this double thread arrangement of the invention employed in the construction of a watch.

It is to be nuderstand that such an effect of this invention may also be used in other fields of design, manufacture and articles which require water proof, air tight and anti-pressure installations.

While this invention has been described in connection with what is presently considered to be the most practical and preferred embodiment, itis to be understand that the invention is not limited to the contents disclosed herein, but on the contrary, it is intended to cover various modifications and equivalent arrangements included within the spirit and scope of the appended claim.

What is claimed is:

1. A watch with improved water-proof and pressure-resistance characteristics of, said watch comprising:

(a) a casing, a bottom cover affixed to said casing, a screw winding crown, and a receiving port on said casing for receiving said screw winding crown;

(b) a first double-thread coupling arrangement provided between said screw winding crown and said receiving port, said first double-thread coupling arrangement comprising an externally and internally threaded annular section provided on said screw winding crown, a matching externally and internally threaded annular recess provided in said receiving port, and a first packing ring provided between said receiving port and said screw winding crown; and (c) a second double-thread coupling arrangement provided between said casing and said bottom cover, said second double-thread coupling arrangement comprising an externally and internally threaded annular protrusion provided on said casing, a matching externally and internally threaded annular groove provided in said bottom cover, and a second packing ring provided between said casing and said bottom cover.

* * * * *